United States Patent [19]

Witting

[11] Patent Number: 5,032,757

[45] Date of Patent: Jul. 16, 1991

[54] PROTECTIVE METAL HALIDE FILM FOR HIGH-PRESSURE ELECTRODELESS DISCHARGE LAMPS

[75] Inventor: Harald L. Witting, Burnt Hills, N.Y.

[73] Assignee: General Electric Company, Schenectady, N.Y.

[21] Appl. No.: 489,319

[22] Filed: Mar. 5, 1990

[51] Int. Cl.[5] ..... H01J 61/00; H01J 61/33

[52] U.S. Cl. ..... 313/44; 313/46; 313/635; 313/489; 315/248

[58] Field of Search ..... 313/44, 46, 47, 635, 313/489, 638; 315/248

[56] References Cited

U.S. PATENT DOCUMENTS

| | | | |
|---|---|---|---|
| 1,897,586 | 2/1933 | Pirani | 313/44 |
| 4,342,937 | 8/1982 | Nagel | 313/47 |
| 4,803,404 | 2/1989 | Anderson | 315/248 |
| 4,810,938 | 3/1989 | Johnson et al. | 315/248 |
| 4,812,702 | 3/1989 | Anderson | 315/153 |
| 4,910,439 | 3/1990 | El-Hamamsy et al. | 313/638 |
| 4,972,120 | 11/1990 | Witting | 313/638 |

FOREIGN PATENT DOCUMENTS

| | | | |
|---|---|---|---|
| 0206025 | 1/1984 | Fed. Rep. of Germany | 313/635 |
| 0003849 | 1/1985 | Japan | 313/635 |

OTHER PUBLICATIONS

Waymouth, John F., "Electric Discharge Lamps", M.I.T. Press, 1971, pp. 266–277.

*Primary Examiner*—Donald J. Yusko
*Assistant Examiner*—N. D. Patel
*Attorney, Agent, or Firm*—Jill M. Breedlove; James C. Davis, Jr.; Marvin Snyder

[57] ABSTRACT

An electrodeless high intensity discharge lamp having an excitation coil disposed about an arc tube includes thermal apparatus for ensuring that a metal halide condensate forms a protective film on the portion of the arc tube which is nearest the plasma arc discharge during lamp operation. For a short, cylindrical arc tube, the thermal apparatus comprises a heat shield situated on the top and/or bottom thereof. In one embodiment, the bottom of the arc tube is concave to ensure that the condensate does not collect on the bottom of the arc tube. The excitation coil may be situated sufficiently close to the arc tube to ensure that enough heat is removed from the side wall of the arc tube to a heat sink so that the protective metal halide film forms on the inner surface of the arc tube wall. An outer glass envelope is preferably situated between the arc tube and the excitation coil, which envelope also functions to remove heat from the arc tube side wall.

20 Claims, 3 Drawing Sheets

PROTECTIVE METAL HALIDE FILM FOR HIGH-PRESSURE ELECTRODELESS DISCHARGE LAMPS

FIELD OF THE INVENTION

The present invention relates generally to electrodeless high intensity discharge lamps. More particularly, the present invention relates to apparatus for protecting the arc tube of an electrodeless high intensity discharge lamp from erosion by the plasma arc discharge formed therein and thus extending the lamp's useful life.

BACKGROUND OF THE INVENTION

In a high intensity discharge (HID) lamp, a medium to high pressure ionizable gas, such as mercury or sodium vapor, emits visible radiation upon excitation typically caused by passage of radio frequency (RF) current through the gas. One class of HID lamps comprises electrodeless lamps which generate an arc discharge by establishing a solenoidal electric field in a high-pressure gaseous lamp fill comprising the combination of a metal halide and an inert buffer gas. In particular, the lamp fill, or discharge plasma, is excited by RF current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary. RF current in the excitation coil produces a changing magnetic field, in turn creating an electric field in the plasma which closes completely upon itself, i.e., a solenoidal electric field. Current flows as a result of this electric field, thus producing a toroidal arc discharge in the arc tube.

Electrodeless HID lamps generally provide good color rendition and high efficacy in accordance with the standards of general purpose illumination. However, the lifetime of such lamps can be limited by erosion of the portion of the arc tube nearest the high intensity arc discharge. Erosion of the arc tube may be attributable to chemical reactions caused by intense ion bombardment and radiation from the arc discharge. For example, in an HID lamp containing a sodium iodide fill, as explained in Electric Discharge Lamps by John F. Waymouth, M.I.T. Press, 1971, pp. 266–277, sodium iodide is dissociated by the arc discharge into positive sodium ions and negative iodine ions. The positive sodium ions are driven towards the arc tube wall by the electric field of the arc discharge. Sodium ions which do not recombine with iodine ions before reaching the wall may react chemically at the wall, or they may be lost by passing through the wall. Not only does the arc tube surface degrade, but as more and more sodium atoms are lost, light output decreases. Moreover, there is a buildup of free iodine within the arc tube that leads to arc instability and eventual arc extinction.

OBJECTS OF THE INVENTION

Accordingly, it is an object of the present invention to provide a new and improved electrodeless HID lamp including apparatus for protecting the arc tube from erosion by the arc discharge therein so as to extend the useful life of the lamp.

Another object of the present invention is to provide, for the arc tube of an electrodeless HID lamp, a protective metal halide film to cover the surface of the arc tube which is nearest the plasma arc discharge during lamp operation.

Still another object of the present invention is to maintain the portion of the arc tube wall which is nearest the plasma arc discharge in an electrodeless HID lamp at a lower temperature than the remainder of the arc tube so that a condensate of metal halide forms a protective film thereon.

SUMMARY OF THE INVENTION

The foregoing and other objects of the present invention are achieved in a new and improved electrodeless HID lamp including thermal means for protecting the surface of the arc tube from erosion by the high intensity arc discharge therein, thus extending the useful life of the lamp. The preferred arc tube structure is that of a short cylinder, or "pillbox", having rounded edges. The arc tube fill comprises a metal halide in a quantity sufficient to provide a metal halide condensate in the arc tube during lamp operation and an inert buffer gas. In accordance with the present invention, the thermal means operates to maintain the portion of the arc tube which is nearest the plasma arc discharge at a lower temperature than the rest of the arc tube so that the metal halide condensate forms a protective film thereon. In a first preferred embodiment of the present invention, the thermal means comprises a heat shield situated at the bottom of the arc tube which reflects heat into the arc tube. A second preferred embodiment comprises an arc tube having a concave bottom which serves to prevent the condensate from collecting on the bottom of the arc tube. Additionally, if desired, a heat shield may be situated on the concave bottom of the arc tube. In yet a third preferred embodiment, the protective metal halide film is formed by situating the excitation coil sufficiently close to the arc tube so that the sides of the arc tube are cooled sufficiently by conduction to the excitation coil, which operates at much lower temperatures than the arc tube and, in turn, is cooled by conduction to a heat sink. Finally, a fourth preferred embodiment includes an outer, light-transmissive envelope surrounding the arc tube.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
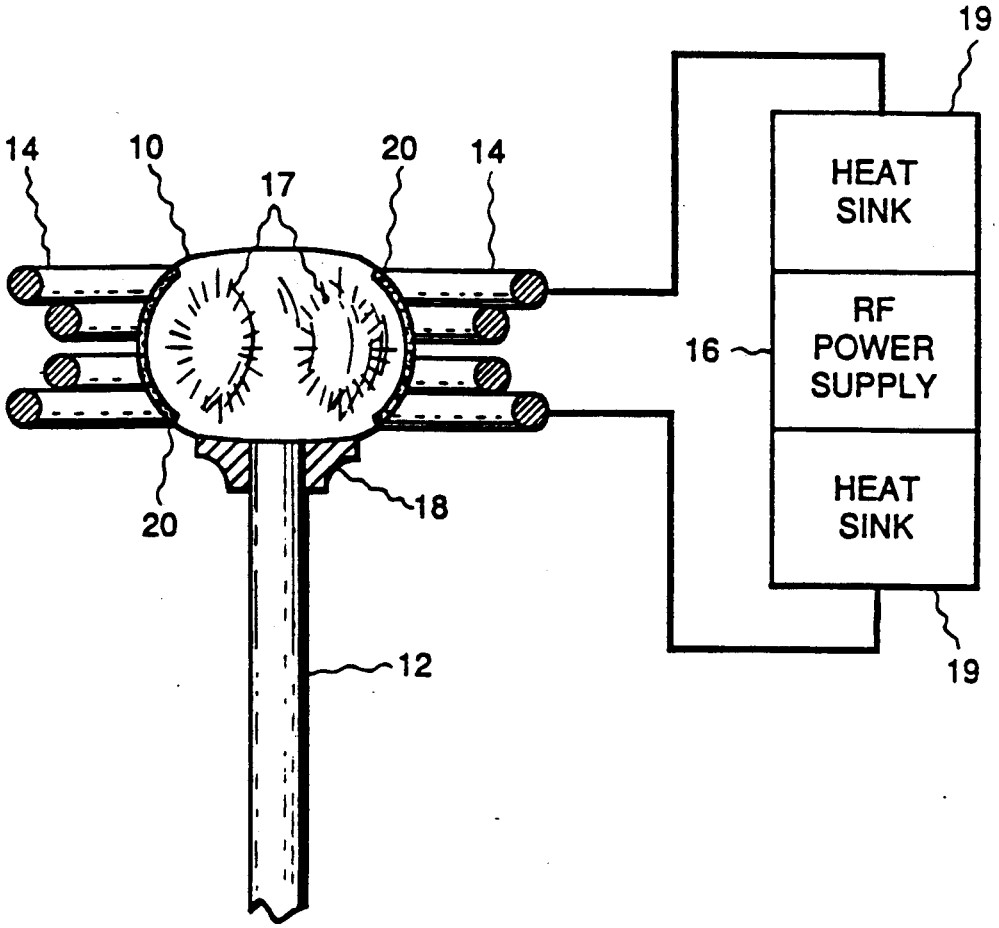
FIG. 1 is a partially cutaway side view of an electrodeless HID lamp including thermal means for protecting the arc tube from erosion by the plasma arc discharge in accordance with a first preferred embodiment of the present invention.
Figure 2:
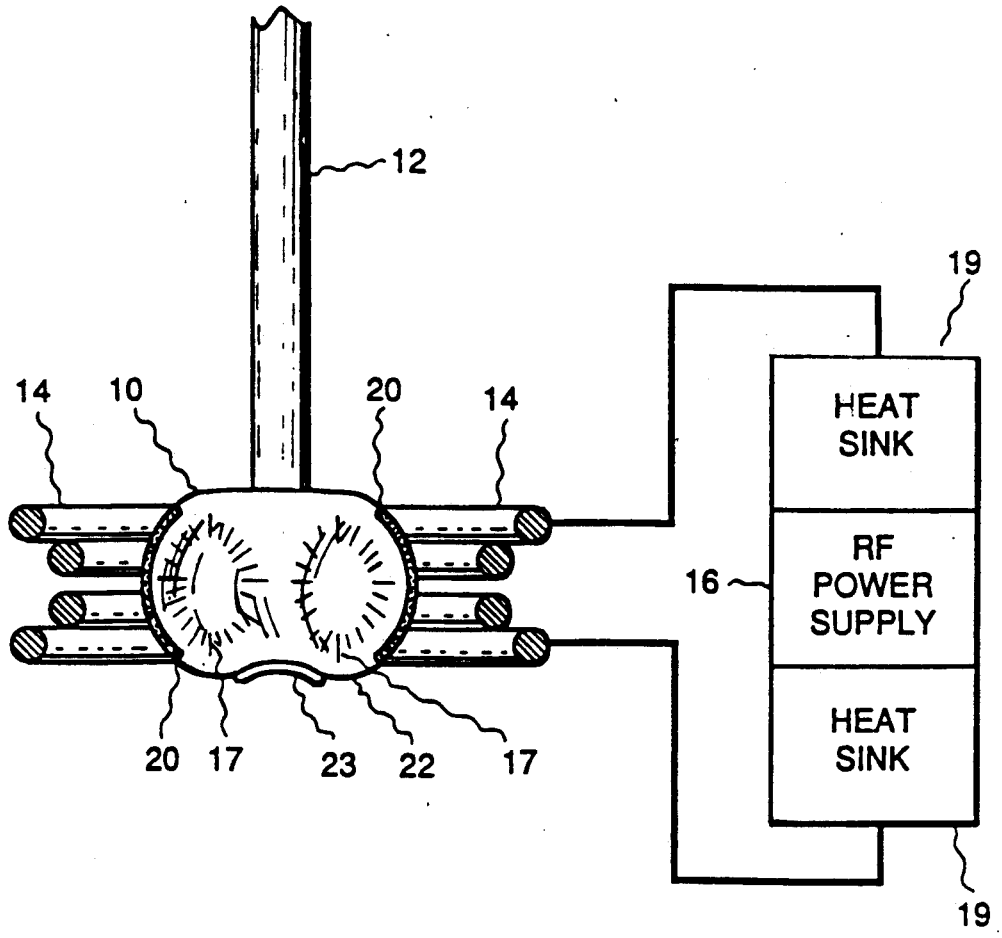
FIG. 2 is a partially cutaway side view of an electrodeless HID lamp including thermal means for protecting the arc tube from erosion in accordance with an alternative embodiment of the present invention.
Figure 3:
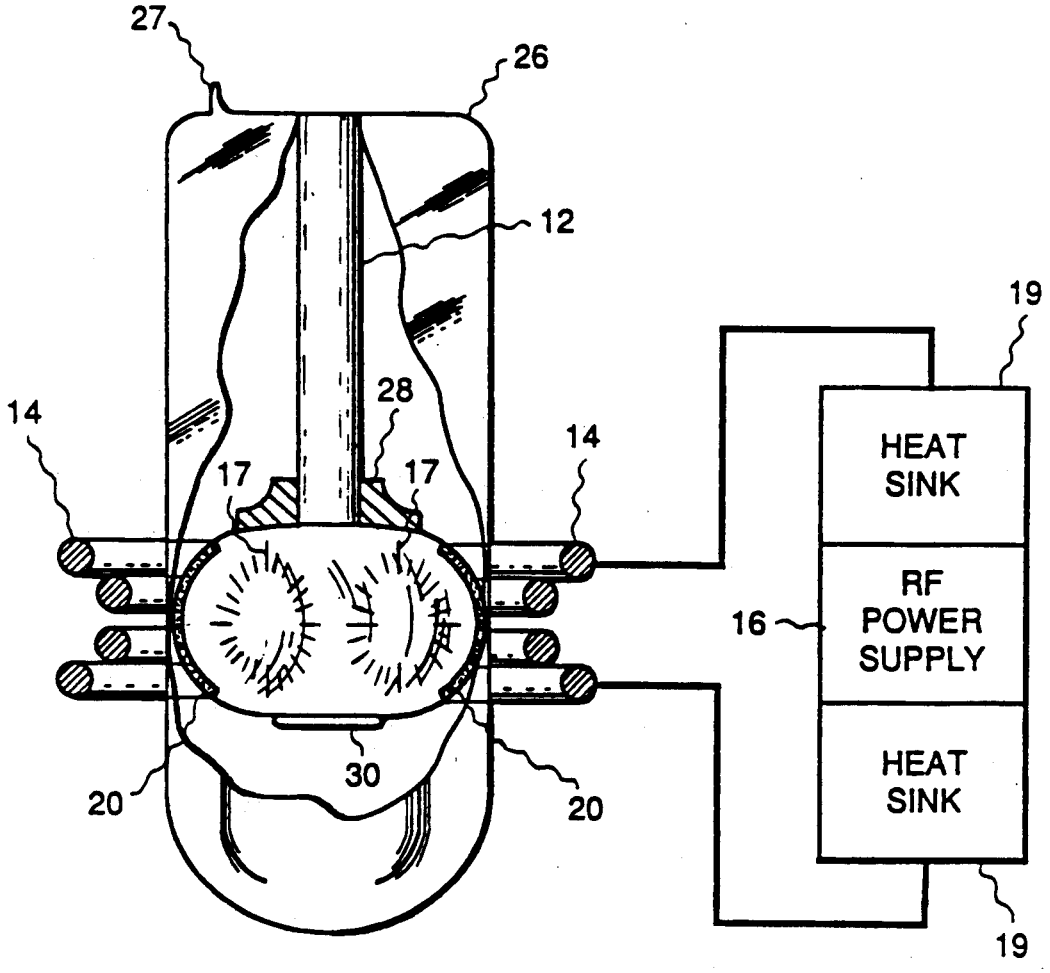
FIG. 3 is a partially cutaway side view of an electrodeless HID lamp including thermal means for protecting the arc tube from erosion in accordance with another alternative embodiment of the present invention.

FIG. 1 shows an HID lamp of the present invention which includes an arc tube 10 supported by a rod 12. Although rod 12 is illustrated as supporting arc tube 10 at its bottom, the arc tube alternatively may be supported at its top, if desired, as shown in FIGS. 2 and 3. As illustrated, the preferred structure of arc tube 10 is that of a short cylinder, or "pillbox", having rounded edges. As described in commonly assigned U.S. Pat. No. 4,810,938, issued to P.D. Johnson and J.M. Anderson on Mar. 7, 1989, which patent is hereby incorporated by reference, such a structure promotes more nearly isothermal operation, thus decreasing thermal losses and hence increasing efficiency. The arc tube is preferably formed of a high temperature glass, such as fused quartz, or an optically transparent ceramic, such as polycrystalline alumina.

Electrical power is applied to the HID lamp by an excitation coil 14 disposed about arc tube 10 and connected to a radio frequency (RF) power supply 16. In operation, RF current in coil 14 results in a changing magnetic field which produces within arc tube 10 an electric field which completely closes upon itself. Current flows through the fill within arc tube 10 as a result of this solenoidal electric field, producing a toroidal arc discharge 17 in arc tube 10. Suitable operating frequencies for the RF power supply are in the range from 1 megahertz to 30 megahertz, an exemplary operating frequency being 13.56 megahertz.

For efficient lamp operation, the excitation coil must not only have satisfactory coupling to the discharge plasma, but must also have low resistance and small size. A practical coil configuration avoids as much light blockage by the coil as practicable and hence maximizes light output. By way of example, coil 14 is illustrated as having four turns which are arranged to have a substantially V-shaped cross section on each side of a coil center line. A similar coil configuration, having six turns, is described in commonly assigned U.S. Pat. No. 4,812,702 of J.M. Anderson, issued Mar. 14, 1989, which patent is hereby incorporated by reference.

Typically, the excitation coil of an HID lamp is coupled to a heat sink for removing excess heat from the excitation coil during lamp operation in order to limit coil losses. That is, as the temperature of the excitation coil increases, coil resistance increases, thereby resulting in higher coil losses. A suitable heat sink for cooling the excitation coil of an electrodeless HID lamp comprises heat sink fins 19 coupled to RF power supply 16, such as those described in commonly assigned U.S. Pat. No. 4,910,439 of S.A. El-Hamamsy and J.M. Anderson, issued Nov. 30, 1989, which patent is hereby incorporated by reference.

The fill enclosed by arc tube 10 comprises a combination of one or more metal halides and a buffer in a sufficient quantity to chemically limit the transport of energy from the hot core of the arc discharge to the walls of the arc tube. Suitable metal halides are: sodium iodide, scandium iodide, thallium iodide, lithium iodide, indium iodide, zinc iodide, lanthanum iodide and cerium chloride. An inert gas, such as xenon or krypton, may comprise a suitable buffer. More specifically, a suitable HID lamp fill comprises a sodium halide, a cerium halide and xenon combined in weight porportions to generate visible radiation exhibiting high efficacy and good color rendering capability at white color temperatures, as described in Johnson et al. U.S. Pat. No. 4,810,938, cited hereinabove. For example, a fill according to the Johnson et al. patent may comprise sodium iodide and cerium chloride, in equal weight porportions, in combination with xenon at a partial pressure of about 500 torr. Another suitable fill is described in U.S. Pat. No. 4,972,120 of H.L. Witting, issued Nov. 20, 1990, and assigned to the instant assignee. The fill of the Witting patent, which is hereby incorporated by reference, comprises a combination of a lanthanum halide, a sodium halide, a cerium halide and xenon or krypton as a buffer gas. For example, a fill according to the Witting patent may comprise a combination of lanthanum iodide, sodium iodide, cerium iodide, and 250 torr partial pressure of xenon.

In accordance with the present invention, the arc tube fill comprises a metal halide in a quantity sufficient to provide a reservoir of metal halide condensate in the arc tube during lamp operation. The metal halide pressure in an operating HID lamp is controlled by the temperature of the reservoir which forms in the coolest portion of the arc tube. Typical HID arc tube temperatures are in the range from 850° C. to 1000° C. In prior art HID lamps, the coolest portion of the arc tube is at the bottom thereof because the upper portions of the arc tube are heated by convection. In addition, the portion of the arc tube wall nearest the arc discharge during lamp operation is heated by the intense heat of the arc discharge.

In accordance with the present invention, the temperature of the lower portion of the arc tube is raised, and/or the temperature of the arc tube wall nearest the arc discharge during lamp operation is reduced-, so that the temperature of the wall portion is less than that of the lower portion. As a result, the reservoir of metal halide condensate forms a film on the inner surface of the portion of the arc tube wall nearest the arc discharge, thereby protecting the arc tube wall from damage caused by the intense heat of the discharge and extending the lamp's useful life. According to a preferred embodiment, excess metal halide is added in a sufficient quantity such that a protective metal halide film covers at least 30% of the total inner surface area of arc tube 10.

Like the arc tube wall, the metal halide film is subject to damage by ion bombardment and radiation from the arc discharge. However, the film maintains a dynamic equilibrium with the discharge region through the processes of evaporation, condensation, dissociation and recombination. These process heal or ameliorate damage to the film caused by the arc discharge.

As shown in FIG. 1, a heat shield 18 is used to raise the temperature of the lower portion of arc tube 10 so that the metal halide condensate forms a protective film 20 on the inner surface of the arc tube side wall. A suitable heat shield comprises a coating of a white powder, such as alumina, silica or magnesia. Such a coating functions to reflect heat back into the arc tube, while absorbing very little of the visible light output from the lamp. Alternatively, a suitable heat shield comprises a film capable of reflecting infrared heat and transmitting visible light. An exemplary film is a multilayer film comprising the oxides of titanium, silicon and tantalum. Still another alternative embodiment of heat shield 18 comprises an insulating material, such as quartz wool. Furthermore, if desired, another heat shield may be disposed on the top of arc tube 10 to ensure that the arc tube side wall is at the lowest temperature.

FIG. 2 illustrates a second preferred embodiment of the present invention wherein the bottom 22 of arc tube 10 is concave so that the reservoir of metal halide condensate is prevented from collecting thereon, thus forcing the condensate to move toward the side wall of the arc tube and to provide a protective film 20 thereon. As illustrated, a heat shield 23 may be located on concave bottom 22 of arc tube 10, if desired. Moreover, another heat shield (not shown) may be disposed on the top of arc tube 10, if desired.

Arc tube 10 may be situated sufficiently close to excitation coil 14 to ensure that enough heat is removed from the side wall of the arc tube to heat sink 19 so that the protective metal halide film forms on the inner surface of the arc tube side wall. In particular, the arc tube wall is cooled by conduction to the excitation coil which operates at a lower temperature than the arc tube. In turn, excitation coil 14 is cooled by heat conduction to the heat sink. With the arc tube located sufficiently close to the excitation coil, heat shields and/or a concave bottom may not be deemed necessary.

FIG. 3 illustrates still another preferred embodiment of the present invention. Arc tube 10 is mounted in an outer glass envelope 26 having an exhaust tip 27 for evacuation and backfill of gas in the space between arc tube 10 and envelope 26. As shown, excitation coil 14 is disposed about envelope 26. In this case, the arc tube side wall is maintained at a lower temperature than the top and bottom of the arc tube by means of heat conduction to the envelope. In FIG. 3, heat shields 28 and 30 are illustrated as being situated at the top and bottom, respectively, of the arc tube to ensure that the temperature thereof remains higher than that of the arc tube side wall. However, it is to be understood that an outer glass envelope, such as envelope 26 of FIG. 3, may be used in combination with any of the other hereinabove described embodiments of the present invention to aid in maintaining the arc tube side wall at a lower temperature than the top and bottom thereof.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless high intensity discharge lamp, comprising:

a light transmissive arc tube for containing a plasma arc discharge, said arc tube having a top, a bottom, and a side wall;

a fill disposed in said arc tube, said fill including at least one metal halide and a buffer gas, the amount of said metal halide being selected so that a reservoir of metal halide condensate is present during operation of said lamp;

excitation means for coupling radio frequency energy to said fill; and thermal means for maintaining the portion of said arc tube nearest said plasma arc discharge at a lower temperature than the remainder of said arc tube so that said metal halide condensate forms a protective film on the inner surface thereof during operation of said lamp.

2. The lamp of claim 1 wherein said metal halide film covers at least 30% of the inner surface of said arc tube.

3. The lamp of claim 1 wherein said arc tube is substantially cylindrically shaped with the height of said arc tube being less than the outside diameter thereof.

4. The lamp of claim 3 wherein the edges of said arc tube are rounded.

5. The lamp of claim 1 wherein said thermal means comprises heat shield means disposed proximate the bottom of said arc tube.

6. The lamp of claim 1 wherein said heat shield means comprises a powder coating selected from the group consisting of alumina, silica, and magnesia powder coatings.

7. The lamp of claim 5 wherein said heat shield means comprises quartz wool.

8. The lamp of rlaim 5 wherein said thermal means further comprises heat shield means disposed proximate the top of said arc tube.

9. The lamp of claim 5 wherein the bottom of said arc tube is concave, said thermal means further comprising said concave bottom.

10. The lamp of claim 1 wherein the bottom of said arc tube is concave, said concave bottom comprising said thermal means.

11. The lamp of claim 1 wherein said thermal means comprises an outer light transmissive envelope surrounding said arc tube, said excitation coil being disposed about said envelope.

12. The lamp of claim 11 wherein said thermal means further comprises heat shield means disposed proximate the bottom of said arc tube.

13. The lamp of claim 12 wherein said heat shield means comprises a powder coating selected from the group consisting of alumina, silica, and magnesia powder coatings.

14. The lamp of claim 12 wherein said heat shield means comprises quartz wool.

15. The lamp of claim 12 wherein said thermal means further means further comprises heat shield means disposed proximate the top of said arc tube.

16. The lamp of claim 11 wherein the bottom of said arc tube is concave, said concave bottom further comprising said thermal means.

17. The lamp of claim 1 wherein said thermal means comprises:

heat sink means for removing heat from said excitation coil wherein said excitation coil is spaced sufficiently close to said arc tube such that enough heat is removed from the side wall of said arc tube by conduction to form said protective film.

18. The lamp of claim 1 wherein said metal is selected from the group consisting of sodium, scandium, thallium, lithium, indium, zinc, lanthanum, cerium and mixtures thereof.

19. The lamp of claim 1 wherein said halide is selected from the group consisting of iodides, chlorides, and bromides and mixtures thereof.

20. The lamp of claim 1 wherein said buffer gas is selected from the group consisting of xenon and krypton.

* * * * *